US007578255B2

(12) United States Patent
Pittenger

(10) Patent No.: US 7,578,255 B2
(45) Date of Patent: Aug. 25, 2009

(54) COMBINATION DOOR KNOCKER, PEEP HOLE, AND DECORATION HANGER

(76) Inventor: Lisa Marlene Pittenger, 18393 Eagle Point Sq., Leesburg, VA (US) 20176

( * ) Notice: Subject to any disclaimer, the term of this patent is extended or adjusted under 35 U.S.C. 154(b) by 78 days.

(21) Appl. No.: 11/889,372

(22) Filed: Aug. 13, 2007

(65) Prior Publication Data

US 2009/0044452 A1 Feb. 19, 2009

(51) Int. Cl.
*E06B 7/30* (2006.01)

(52) U.S. Cl. ..... 116/148; 116/DIG. 12

(58) Field of Classification Search ..... 116/1, 116/148, 150, 167, 172, 200, 280, DIG. 1, 116/DIG. 12; 220/663; 359/504; 40/617; 49/171; D8/401

See application file for complete search history.

(56) References Cited

U.S. PATENT DOCUMENTS

| | | | | | |
|---|---|---|---|---|---|
| D70,534 | S | * | 7/1926 | Calder | D8/401 |
| 2,262,203 | A | * | 11/1941 | Redstone et al. | 359/504 |
| 2,523,158 | A | * | 9/1950 | Starp | 116/172 |
| 3,734,054 | A | * | 5/1973 | Anderson | 116/148 |
| D241,608 | S | * | 9/1976 | Kunkel | D8/401 |
| 5,123,223 | A | * | 6/1992 | Makarevich et al. | 52/311.1 |
| 5,426,891 | A | * | 6/1995 | Svehaug | 49/171 |
| 5,814,379 | A | * | 9/1998 | Roccaforte | 428/5 |
| 5,900,802 | A | * | 5/1999 | Segan | 340/328 |
| 6,073,335 | A | * | 6/2000 | Lampers | 29/525.01 |

* cited by examiner

*Primary Examiner*—R. Alexander Smith

(57) ABSTRACT

An integrated peephole, door knocker, and door decoration support hanger constructed as an integral unit to aid in a single installation and preservation of an outward facing door.

10 Claims, 6 Drawing Sheets

COMBINATION DOOR KNOCKER, PEEP HOLE, AND DECORATION HANGER

BACKGROUND OF THE INVENTION

1. Field of the Invention

The present invention is related to an external door apparatus constructed to provide an integrated mechanism for a visitor to acknowledge her presence, an occupant to visually identify the visitor without opening the exterior door, and a support for a decorative object.

2. Discussion of the Background

Many homeowners enhance the purpose and aesthetics of their external doors for safety, visitor acknowledgement, and decoration. Conventional peepholes are installed for the purpose of the occupant to identify the visitor without opening the door. Door knockers are installed to enhance the beauty of the home and to enable the visitor to acknowledge their presence. In addition, many occupants decorate their external doors with wreaths, door swags, and the like to enhance the beauty of the home. These safety and decorative accessories are purchased and installed individually.

As recognized by the present inventor, it is common for these objects to be misaligned during installation, leaving a less than desirable effect. Removable wreath hangers are unstable and often scratch the exterior door. Furthermore, they are usually used during only part of the year, and removing it from the door during off-seasons leaves the owner to repair the damage.

SUMMARY OF THE INVENTION

One purpose of this invention is to provide a combination peephole, door knocker, and decoration hanging device that allows enough room for the decorative object to hang unobtrusively to either the peephole or door knocker.

One object of the present invention is to overcome the difficulties and limitations of conventional approaches to installing individual peepholes, door knockers, and door decoration support hangers.

A feature of the present invention is a combination peephole, door knocker, and door decoration support hanger for installation as a single unit. The combination peephole, door knocker, and door decoration support hanger has a main body of a predetermined width, a predetermined length that extends from a top to a bottom, a predetermined thickness, a front surface, and a back surface.

In one embodiment, the front surface is made up of two contiguous surface portions, which are attached together by a hinge. A first surface portion is oriented above a second surface portion. The first surface portion is configured to support a door decoration support, a peephole, a strike plate, and a stationary top hinge portion. The door decoration support is oriented above the peephole such that when the door decoration support is in use, the door decoration does not obstruct the view from the peephole. The second surface portion is configured to support a non-stationary bottom hinge portion and a door knocker. The first surface portion and the second surface portion are formed as an integral unit.

The back surface is configured to attach the combination peephole, door knocker, door decoration support hanger to the door.

In another embodiment, the door decoration support is a recessed area oriented along the top of the back surface following the contour of the combination peephole, and door decoration support hanger.

In a further embodiment, the door decoration support is at least one hook oriented along the top of the back surface following the contour of the combination peephole, and door decoration support hanger.

In yet another embodiment, the door decoration support is at least one adjustable tab, oriented along the top of the back surface following the contour of the combination peephole, door knocker, and door decoration support hanger.

In still a further embodiment, the door decoration support is a malleable material oriented along the top of the back surface following the contour of the combination peephole, door knocker, and door decoration support hanger.

Another feature of the combination peephole, door knocker, and door decoration support hanger is an engravable area on the first surface portion.

In another embodiment only a peephole and door decoration support hanger are combined.

In another further embodiment, the knocker is detachably attached from the peephole and door decoration support hanger.

In a further embodiment, the engravable area is optional.

The present inventor recognized that there is competition for the space at the center, eye-level portion of a front-door. Although many doors include a centered peephole with a door knocker close by, these devices are usually rendered unfit for their intended purpose when the homeowner installs a wreath. Moving the peephole, or door knocker is not practical, and so it is often the case that the function of these devices is compromised when a wreath-hanger and wreath are installed and displayed on the exterior door.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
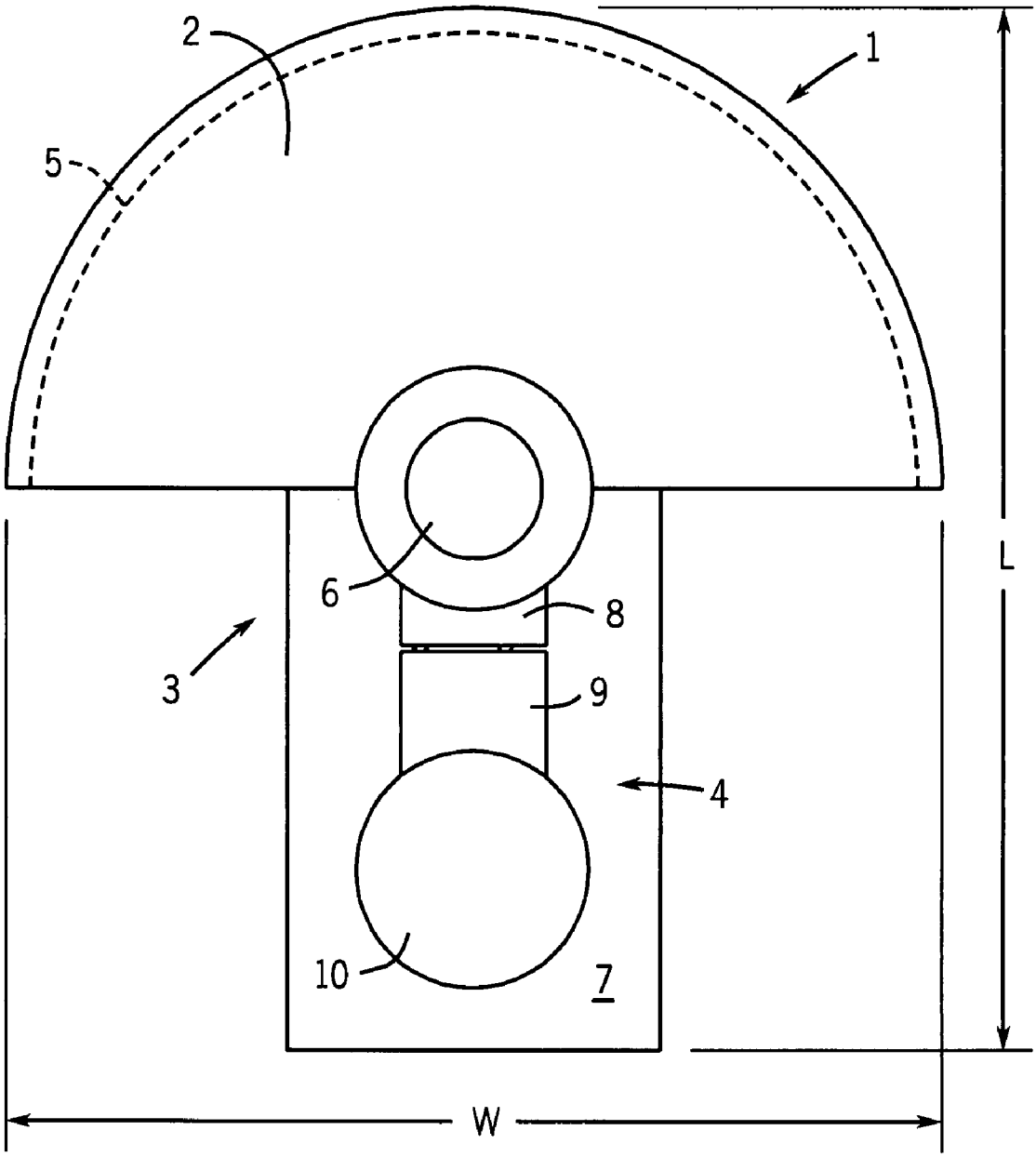
FIG. 1 is a front view of a combination peephole, door knocker, and door decoration support hanger according to the present invention.

Referring now to the drawings, wherein like reference numerals designate identical or corresponding parts throughout the several views, and more particularly to FIG. 1, FIG. 1 shows a first embodiment of a combination peephole, door knocker, and door decoration support hanger according to the present invention. A main body 1 has a predetermined length, L, in an inclusive range of five to nine inches, a width, W, in an inclusive range of five inches to nine inches, and a thickness, T (FIG. 2), in an inclusive range of one half inches to three inches along the length direction. While specific ranges are given, the invention should not be construed as being restricted to these dimensions, within the spirit and scope of the invention. The L, W, and T dimensions may vary according to the door size. For example, a small size (and thus smaller dimensions) is more appropriate for apartment doors, while larger sizes are more appropriate for larger scaled doors of large estate homes. The main body 1 and associated components are optionally constructed of molded plastic, metal (e.g., brass, chrome, steel, or the like), or hybrid parts. These parts are either integrally formed, or assembled, such as with screws or adhesive, as subcomponents.

The main body 1 has a front surface 2 that includes a first surface portion 3 to support a stationary portion of the combination peephole, door knocker, door decoration support hanger, and a second surface portion 4 to support a non-stationary portion of the combination peephole, door knocker, and door decoration support hanger. The first surface portion 3 supports a door decoration support 5, a peephole 6, a strike plate 7, and a stationary top hinge portion 8. The door decoration support 5 is a recessed area oriented along an outside contour of the first surface portion 3. The door decoration support 5 could also be made from hooks, adjustable tabs, or a malleable material that is able to support a decorative object. The door decoration support 5 is configured to enable the decorative object to be displayed without obstructing the view from the peephole. The second surface portion 4 supports a non-stationary bottom hinge portion 9 and a door knocker 10. When used, the door knocker 10 is rotated about the hinge and then brought into contact with the door or an optional strike plate 7 to make an audible noise.

Figure 2:
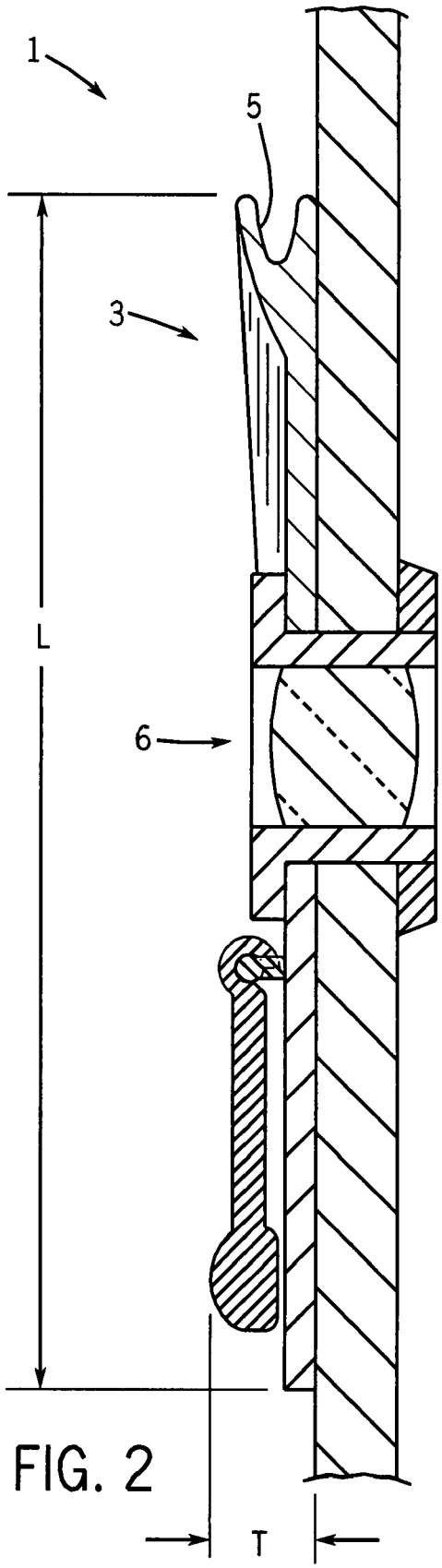
FIG. 2 is a side view of the combination peephole, door knocker, and door decoration support hanger of FIG. 1.

FIG. 2 is a side view of the combination peephole, door knocker, and door decoration support hanger shown in FIG. 1. In this embodiment the main body 1 is made of a molded stainless steel. However, the main body 1 could also be made from a molded aluminum, brass or other material that is able to support a door decoration. The main body 1 has a thickness, T, in an inclusive range of one half inches to three inches along the length, L, direction. The door decoration support 5 is a recessed area oriented along an outside contour of the first surface portion 3. The door decoration support 5 could also be a least one hook, or at least one adjustable tab, or a malleable material oriented along an outside contour of the first surface portion 3 that is able to support a door decoration. The peephole 6 provides an unobstructed view.

Figure 3:
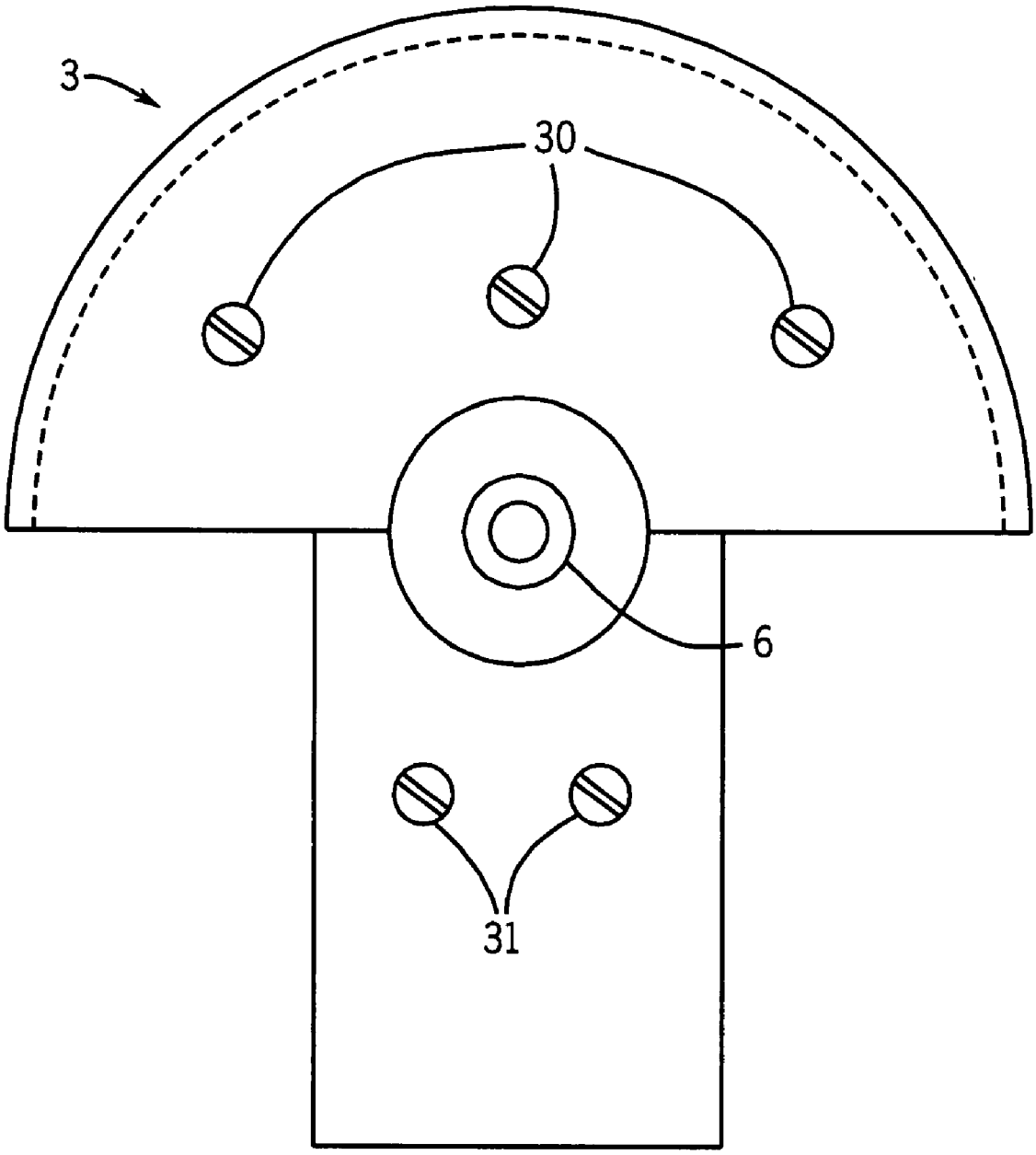
FIG. 3 is a back view of a combination peephole, door knocker, and door decoration support hanger according to FIG. 1.

FIG. 3 shows a back view of a combination peephole, door knocker, and door decoration support hanger according to the present invention. The first surface portion 3 provides a primary attachment area 30 oriented above the peephole 6 and a secondary attachment area 31 oriented below the peephole 6. The combination peephole, door knocker, and door decoration support hanger is attached to a door using screws. The glass for the peephole 6 is optionally integrated into the structure, or it is installed separately and the structure includes a through bore that is aligned with the peephole and provides an unobstructed view through the peephole.

Figure 4:
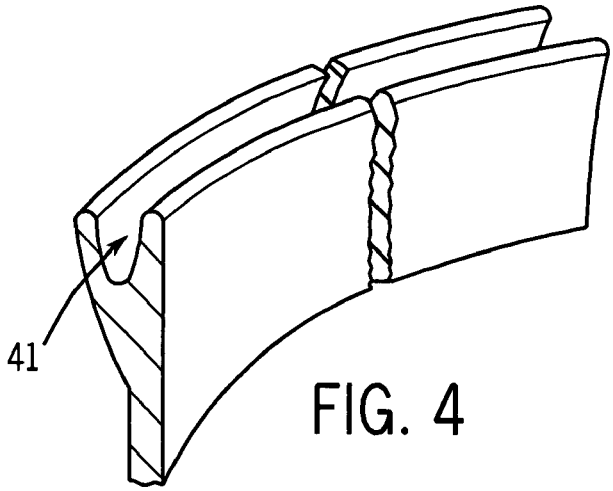
FIG. 4 is a cross section view of the recessed decoration hanger according to the present invention.

FIG. 4 shows the door decoration support hanger as a recessed area 41. The recessed area 41 is formed in the first surface portion 3 of FIG. 1. The door decoration rests upon this recessed area 41.

Figure 5:
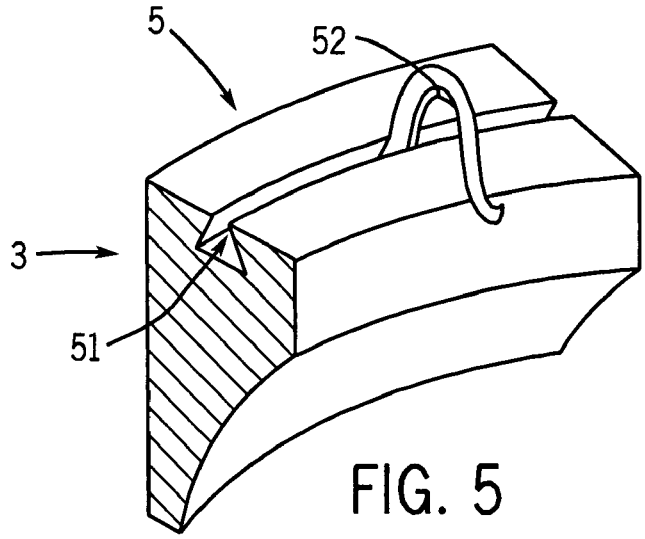
FIG. 5 is a cross section view of the keyed slot decoration hanger embodiment of the present invention.
Figure 6:
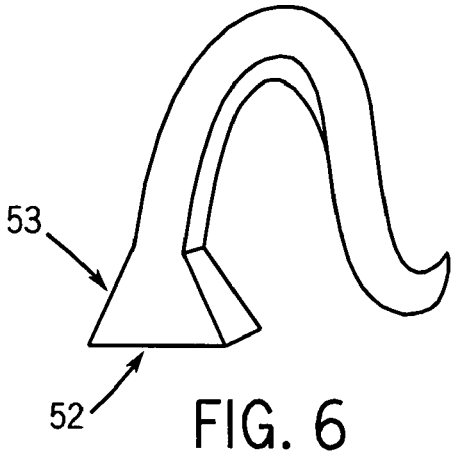
FIG. 6 is a side view of a slidable hook.

FIG. 5 shows the door decoration support hanger as a keyed slot. The keyed slot door decoration support hanger 5 is formed in the first surface portion 3 that receives one or more slidable hooks 52 that are removably slid in the keyed slot 51 when support is needed for the decorative object. In FIG. 1, the keyed slot is shown in dashed lines. The slot has a keyed opening 51, such as in a dovetail shape. A hook 52 to be installed has a shape at a keyed-end 53 as shown in FIG. 6 opposite to the hook, where this keyed-end 53 has a cross-section made to be received in the keyed opening. When installed, the hook 52 cannot be removed from the front because the keyed-end 53 of the hook 52 as shown in FIG. 6 is held by the slot.

FIG. 6 shows a side view of the slidable hook 52 that is inserted into the keyed opening 51 of FIG. 5. The slidable hook 52 has a shape at a keyed-end opposite to the hook, where this keyed-end 53 has a cross-section made to be received in the keyed opening 51 of FIG. 5. When installed, the hook 52 cannot be removed from the front because the keyed-end 53 of the hook 52 is held by the slot 51 of FIG. 5.

Figure 7:
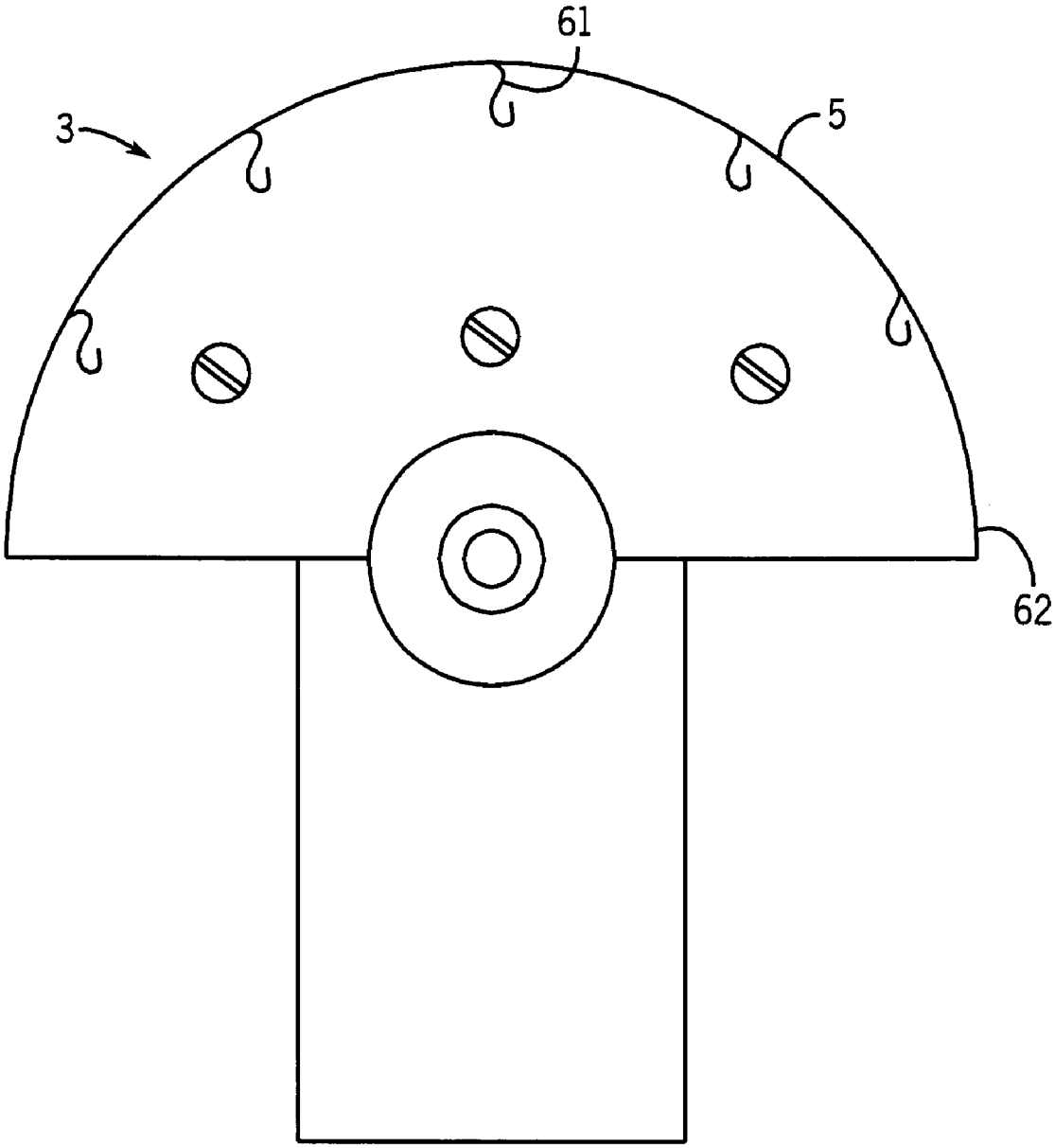
FIG. 7 is a back view of the at least one hook decoration hanger embodiment of the present invention.

FIG. 7 shows a back view of the first surface portion 3 wherein the door decoration support hanger 5 being at least one hook 61 on an outer perimeter 62 of the primary attachment area 3 of FIG. 3.

Figure 8:
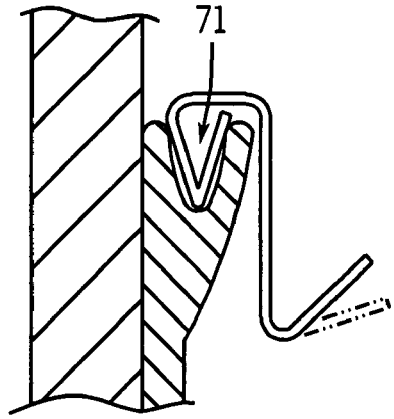
FIG. 8 is a cross section view of the at least one adjustable tab decoration hanger embodiment.

FIG. 8 shows a side view of the door decoration support hanger 5 being at least one adjustable tab 71 on an outer perimeter of the primary attachment area 3 of FIG. 3.

Figure 9:
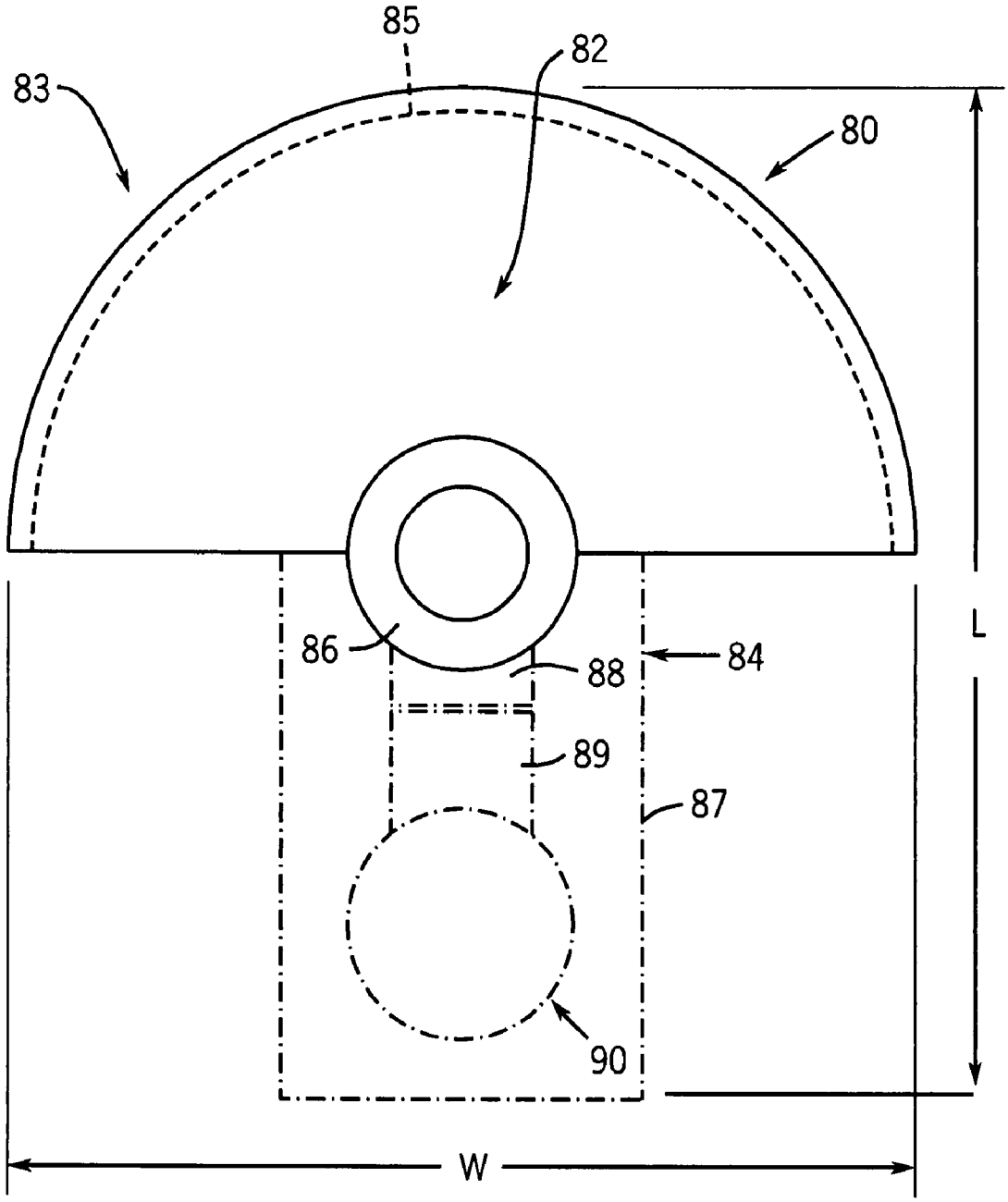
FIG. 9 is a front view of a combination peephole and door decoration support hanger noting that the door knocker, non-stationary hinge, and strike plate may be removably attached.

FIG. 9 shows another embodiment of a combination peephole and door decoration support hanger with the door knocker 90 and strike plate as optional attachments. A main body 80 has a predetermined length, L, in an inclusive range of five to nine inches, a width, W, in an inclusive range of five inches to nine inches, and a thickness in an inclusive range of one half inches to three inches along the length direction. While specific ranges are given, the invention should not be construed as being restricted to these dimensions, within the spirit and scope of the invention. The L, W, and T dimensions may vary according to the door size. For example, a small size (and thus smaller dimensions) is more appropriate for apartment doors, while larger sizes are more appropriate for larger scaled doors of large estate homes. The main body 80 and associated components are optionally constructed of molded plastic, metal (e.g., brass, chrome, steel, or the like), or hybrid parts. These parts are either integrally formed, or assembled, such as with screws or adhesive, as subcomponents.

The main body 80 has a front surface 82 that includes a first surface portion 83 to support a stationary portion of the combination peephole and door decoration support hanger with the door knocker and strike plate as optional attachments, and an optional second surface portion 84 to support a non-stationary portion of the combination peephole and door decoration support hanger with the door knocker and strike plate as optional attachments. The first surface portion 83 supports door decoration support 85, a peephole 86, and a stationary top hinge portion 88. While the first surface portion 83 is shown having a semi-circular shape, the invention should not be construed as being restricted to this shape. The door decoration support 85 is a recessed area oriented along an outside contour of the first surface portion 83. The door decoration support 85 could also be made from hooks, adjustable tabs, or a malleable material that is able to support a decorative object. The door decoration support 85 is configured to enable the decorative object to be displayed without obstructing the view from the peephole. The optional second surface portion 84 supports a non-stationary bottom hinge portion 89, a removably attached door knocker 90, and a removably attached strike plate 87. When used, the removably attached door knocker 90 is rotated about the hinge, then brought into contact with the removably attached strike plate 87 to make an audible noise.

I claim:

1. A combination peephole, door knocker, and door decoration support hanger comprising:

a main body having a predetermined length that extends from a top to a bottom, a predetermined width, and a predetermined thickness, said main body having a front surface that includes a first surface portion that is oriented above a second surface portion, wherein said first surface portion includes a door decoration support hanger, a peephole, a strike plate, and a stationary top hinge portion, arranged from top to bottom respectively, said door decoration support hanger being a recessed area oriented along an outside contour, said second surface portion includes a non-stationary bottom hinge portion and a door knocker pivotally connected to said bottom hinge portion, said first surface portion and said second surface portion being an integral unit, and said main body having a back surface that includes a primary attachment area oriented above said peephole and a secondary attachment area oriented below said peephole.

2. The combination peephole, door knocker, and door decoration support hanger of claim 1, wherein said first surface portion and said second surface portion being contiguous.

3. The combination peephole, door knocker, and door decoration support hanger of claim 1, wherein said door decoration support hanger is oriented above said peephole.

4. The combination peephole, door knocker, and door decoration support hanger of claim 1, wherein said door decoration support hanger being at least one of a hook, an adjustable tab, or a malleable material oriented along an outside contour of the first surface portion.

5. The combination peephole, door knocker, and door decoration support hanger of claim 1, being made from at least one of a molded stainless steel, aluminum, and brass.

6. A combination peephole and door decoration support hanger comprising:

a main body having a predetermined length that extends from a top to a bottom, a predetermined width, and a predetermined thickness, said main body having a front surface that includes a first surface portion that is oriented above a second surface portion, wherein said first surface portion includes a door decoration support, a peephole being an integral unit, and a stationary top hinge portion, arranged from top to bottom respectively, said second surface portion includes a removably attached non-stationary bottom hinge portion, a removably attached door knocker pivotally connected to said bottom hinge portion, and a removably attached strike plate, said main body having a back surface that includes a primary attachment area oriented above said peephole.

7. The combination peephole and door decoration support hanger of claim 6, wherein said door decoration support hanger is oriented above said peephole.

8. The combination peephole and door decoration support hanger of claim 6, wherein said door decoration support hanger being a recessed area oriented along an outside contour of the first surface portion.

9. The combination peephole and door decoration support hanger of claim 6, wherein said door decoration support hanger being at least one of a hook, an adjustable tab, or a malleable material oriented along an outside contour of the first surface portion.

10. The combination peephole and door decoration support hanger of claim 6, being made from at least one of a molded stainless steel, aluminum, and brass.

* * * * *